US011970839B2

(12) United States Patent
Kean

(10) Patent No.: US 11,970,839 B2
(45) Date of Patent: Apr. 30, 2024

(54) EXCAVATOR WITH IMPROVED MOVEMENT SENSING

(71) Applicant: Deere & Company, Moline, IL (US)

(72) Inventor: Michael G. Kean, Maquoketa, IA (US)

(73) Assignee: Deere & Company, Moline, IL (US)

( * ) Notice: Subject to any disclaimer, the term of this patent is extended or adjusted under 35 U.S.C. 154(b) by 581 days.

(21) Appl. No.: 16/561,556

(22) Filed: Sep. 5, 2019

(65) Prior Publication Data

US 2021/0071393 A1 Mar. 11, 2021

(51) Int. Cl.
*E02F 9/26* (2006.01)

(52) U.S. Cl.
CPC ..... *E02F 9/264* (2013.01); *E02F 9/261* (2013.01)

(58) Field of Classification Search
CPC ..... E02F 9/264; E02F 9/261
See application file for complete search history.

(56) References Cited

U.S. PATENT DOCUMENTS

| | | | |
|---|---|---|---|
| 6,735,888 | B2 | 5/2004 | Green et al. |
| 7,616,563 | B1 | 4/2009 | Koch |
| 9,598,036 | B2 | 3/2017 | Lim et al. |
| 9,745,721 | B2 | 8/2017 | Linstroth et al. |
| 10,829,911 | B2 | 11/2020 | Kennedy et al. |
| 2004/0140923 | A1 | 7/2004 | Tucker et al. |
| 2004/0210370 | A1 | 10/2004 | Gudat et al. |
| 2009/0043462 | A1 | 2/2009 | Stratton et al. |
| 2009/0293322 | A1 | 12/2009 | Faivre et al. |
| 2012/0237083 | A1 | 9/2012 | Lange et al. |
| 2012/0327261 | A1 | 12/2012 | Bilandi et al. |
| 2013/0054097 | A1 | 2/2013 | Montgomery |
| 2013/0103271 | A1 | 4/2013 | Best et al. |
| 2014/0107895 | A1 | 4/2014 | Faivre et al. |
| 2014/0188333 | A1 | 7/2014 | Friend |
| 2014/0208728 | A1 | 7/2014 | Ma et al. |
| 2014/0257647 | A1 | 9/2014 | Wu et al. |
| 2014/0354813 | A1 | 12/2014 | Ishimoto |

(Continued)

FOREIGN PATENT DOCUMENTS

| | | | |
|---|---|---|---|
| CN | 108549771 A | * | 9/2018 |
| DE | 102017215379 A1 | | 3/2019 |

(Continued)

OTHER PUBLICATIONS

Non-Final Office Action for U.S. Appl. No. 16/803,603 dated Dec. 21, 2021, 12 pages.

(Continued)

*Primary Examiner* — Ig T An
(74) *Attorney, Agent, or Firm* — Christopher R. Christenson; Kelly, Holt & Christenson, P.L.L.C.

(57) ABSTRACT

An excavator includes a rotatable house and a bucket operably coupled to the house. An inertial measurement unit (IMU) is operably coupled to the excavator and is configured to provide at least one IMU signal indicative of rotation of the house. A backup camera is disposed to provide a video signal relative to an area behind the excavator. A controller is coupled to the IMU and operably coupled to the backup camera. The controller is configured to receive the at least one IMU signal from the IMU and to generate a position output based on the at least one IMU signal and the video signal from the backup camera.

10 Claims, 7 Drawing Sheets

(56) References Cited

U.S. PATENT DOCUMENTS

| | | | | |
|---|---|---|---|---|
| 2015/0249821 | A1 | 9/2015 | Tanizumi et al. | |
| 2016/0138248 | A1 | 5/2016 | Conway et al. | |
| 2016/0176338 | A1 | 6/2016 | Husted et al. | |
| 2016/0244949 | A1* | 8/2016 | Kanemitsu | G01C 9/00 |
| 2016/0305784 | A1 | 10/2016 | Roumeliotis et al. | |
| 2016/0377437 | A1 | 12/2016 | Brannstrom et al. | |
| 2017/0220044 | A1 | 8/2017 | Sakai et al. | |
| 2018/0137446 | A1* | 5/2018 | Shike | G06Q 50/08 |
| 2018/0277067 | A1 | 9/2018 | Tentinger et al. | |
| 2018/0373966 | A1 | 12/2018 | Beschorner et al. | |
| 2019/0194913 | A1 | 6/2019 | Petrany et al. | |
| 2019/0218032 | A1 | 7/2019 | Whitfield, Jr. et al. | |
| 2019/0302794 | A1 | 10/2019 | Kean et al. | |
| 2020/0071912 | A1 | 3/2020 | Kennedy et al. | |
| 2020/0269695 | A1* | 8/2020 | Pfaff | G06T 11/60 |
| 2020/0310442 | A1* | 10/2020 | Halder | G05D 1/0251 |
| 2020/0325650 | A1* | 10/2020 | Tsukamoto | E02F 9/26 |
| 2020/0347580 | A1* | 11/2020 | Raszga | G06N 3/08 |
| 2020/0353916 | A1 | 11/2020 | Schwartz et al. | |
| 2021/0002850 | A1 | 1/2021 | Wu | |
| 2021/0230841 | A1* | 7/2021 | Kurosawa | E02F 9/24 |

FOREIGN PATENT DOCUMENTS

| | | | |
|---|---|---|---|
| DE | 102017222966 | A1 | 6/2019 |
| DE | 102018209336 | A1 | 12/2019 |
| EP | 2631374 | A1 | 8/2013 |
| EP | 3399109 | A1 | 11/2018 |
| JP | H0971965 | A | 3/1997 |
| JP | 2008101416 | A | 5/2008 |
| JP | 2015195457 | A | 3/2018 |
| JP | 6389087 | B2 | 9/2018 |
| JP | 2019194074 | A | 11/2019 |
| WO | WO 2009086601 | A1 | 7/2009 |
| WO | WO2015121818 | A2 | 8/2015 |

OTHER PUBLICATIONS

German Search Report issued in application No. DE102021200634.5 dated Nov. 5, 2021 (05 pages).

Application and Drawings for U.S. Appl. No. 16/803,603, filed Feb. 27, 2020, 34 pages.

Notice of Allowance for U.S. Appl. No. 16/122,121 dated Sep. 9, 2020, 8 pages.

Prosecution History for U.S. Appl. No. 16/122,121 including: Response to Restriction Requirement dated Feb. 10, 2020, Restriction Requirement dated Dec. 20, 2019, and Application and Drawings filed Sep. 5, 2018, 66 pages.

German Search Report issued in application No. 102020208395.9 dated May 18, 2021 (10 pages).

German Search Report issued in application No. 102019210970.5 dated Apr. 21, 2020, 6 pages.

Non-Final Office Action for U.S. Appl. No. 16/122,121 dated Jun. 23, 2020, 18 pages.

Application and Drawings for U.S. Appl. No. 16/830,730, filed Mar. 26, 2020, 37 pages.

German Search Report issued in counterpart application No. 102020209595.7 dated May 18, 2021 (10 pages).

Non-Final Office Action for U.S. Appl. No. 16/803,603 dated Dec. 1, 2022, 15 pages.

Restriction Requirement for U.S. Appl. No. 16/830,730, dated Oct. 14, 2022, 6 pages.

Non-Final Office Action for U.S. Appl. No. 16/830,730, dated Dec. 19, 2022, 14 pages.

Final Office Action for U.S. Appl. No. 16/803,603, dated Jun. 10, 2022, 14 pages.

Notice of Allowance for U.S. Appl. No. 16/803,603, dated Mar. 30, 2023, 10 pages.

Office Action for U.S. Appl. No. 16/830,730, dated May 1, 2023, 18 pages.

* cited by examiner

EXCAVATOR WITH IMPROVED MOVEMENT SENSING

FIELD OF THE DESCRIPTION

The present invention is related to excavators used in heavy construction. More particularly, the present invention is related to improved motion sensing and control in such excavators.

BACKGROUND

Hydraulic excavators are heavy construction equipment generally weighing between 3500 and 200,000 pounds. These excavators have a boom, a dipper (or stick), a bucket, and a cab on a rotating platform that is sometimes called a house. A set of tracks is located under the house and provides movement for the hydraulic excavator.

Hydraulic excavators are used for a wide array of operations ranging from digging holes or trenches, demolition, placing or lifting large objects, and landscaping. Such excavators are also often used along a roadway during road construction. As can be appreciated, the proximity of such heavy equipment to passing motorists and/or other environmental objects, requires very safe operation. One way in which excavator operational safety is ensured is with the utilization of electronic fences or e-fences. An e-fence is an electronic boundary that is set by an operator such that the excavator bucket/arm will not move beyond a particular limit. Such limits may be angular (left and right stops) and/or vertical (upper and/or lower bounds).

Precise excavator operation is very important in order to provide efficient operation and safety. Providing a system and method that increases excavator operational precision without significantly adding to cost would benefit the art of hydraulic excavators.

The discussion above is merely provided for general background information and is not intended to be used as an aid in determining the scope of the claimed subject matter.

SUMMARY

An excavator includes a rotatable house and a bucket operably coupled to the house. An inertial measurement unit (IMU) is operably coupled to the excavator and is configured to provide at least one IMU signal indicative of rotation of the house. A backup camera is disposed to provide a video signal relative to an area behind the excavator. A controller is coupled to the IMU and operably coupled to the backup camera. The controller is configured to receive the at least one IMU signal from the IMU and to generate a position output based on the at least one IMU signal and the video signal from the backup camera.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
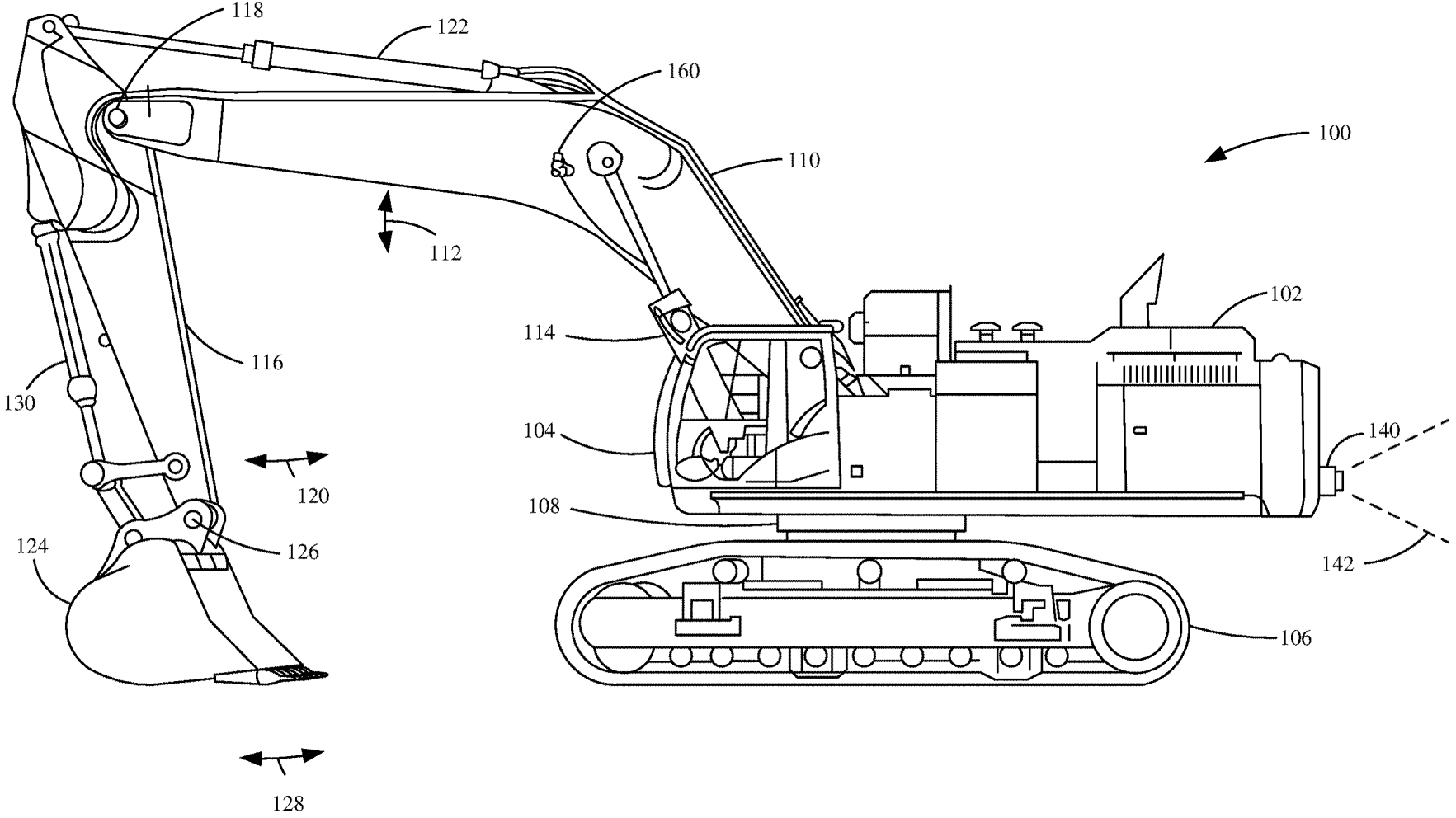
FIG. 1 is a diagrammatic view of a hydraulic excavator with which embodiments of the present invention are particularly applicable.

FIG. 1 is a diagrammatic view of a hydraulic excavator with which embodiments of the present invention are particularly applicable. Hydraulic excavator 100 includes a house 102 having an operator cab 104 rotatably disposed above tracked portion 106. House 102 may rotate 360 degrees about tracked portion 106 via rotatable coupling 108. A boom 110 extends from house 102 and can be raised or lowered in the direction indicated by arrow 112 based upon actuation of hydraulic cylinder 114. A stick 116 is pivotably connected to boom 110 via joint 118 and is movable in the direction of arrows 120 based upon actuation of hydraulic cylinder 122. Bucket 124 is pivotably coupled to stick 116 at joint 126 and is rotatable in the direction of arrows 128 about joint 126 based on actuation of hydraulic cylinder 130.

When an operator within cab 104 needs to back excavator 100 up, he or she engages suitable controls and automatically activates backup camera 140 which provides a backup camera image corresponding to field of view 142 on a display within cab 104. In this way, much like in automobiles, the operator can carefully and safely back the excavator up while viewing the backup camera video output.

Figure 2:
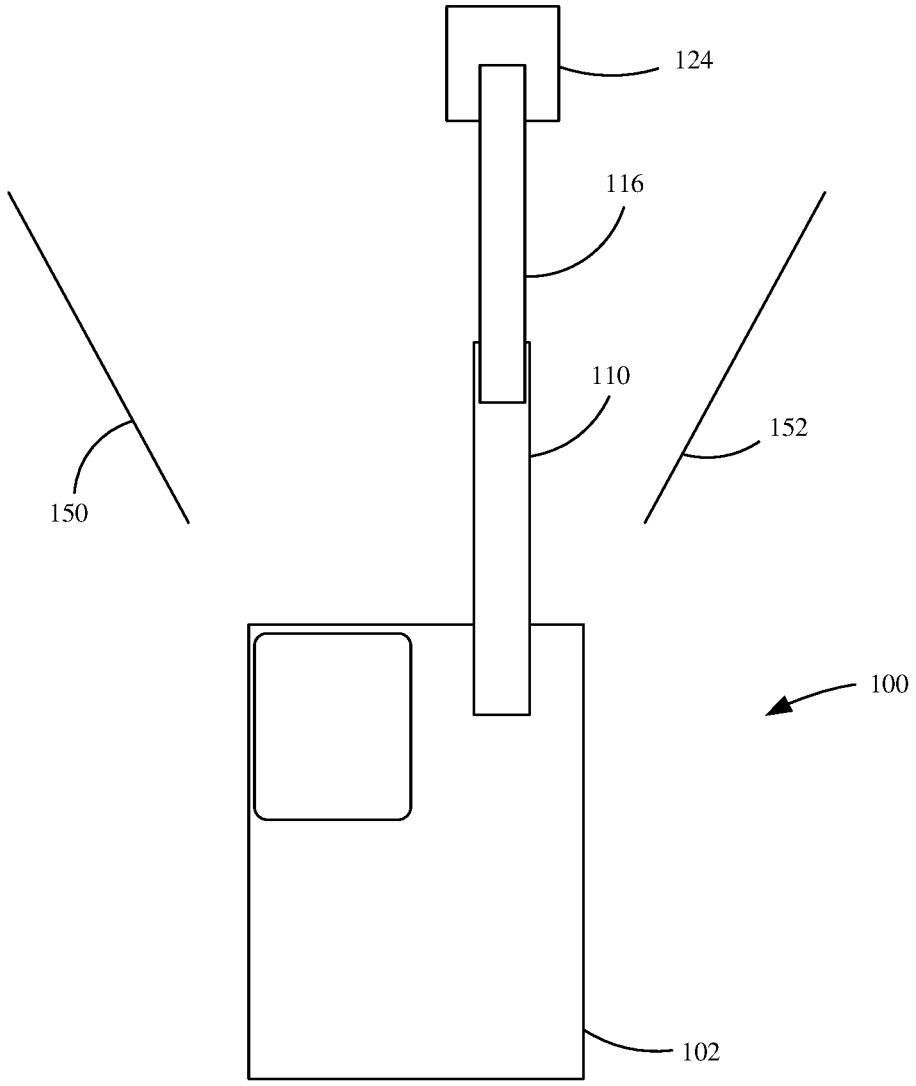
FIG. 2 is a diagrammatic top view of an excavator illustrating an e-fence with which embodiments of the present invention are particularly applicable.

FIG. 2 is a top view of excavator 100 illustrating the operation of angular e-fences 150, 152. An e-fence is an electronic position limit generated by an operator to ensure that the excavator does not move past that position during operation. E-fences are vitally important in operational scenarios where the hydraulic excavator may be operating in close proximity to structures or passing motorists. In order to set an e-fence limit, the operator will typically extend the stick to its maximum reach, and then rotate the house to a first angular limit, such as limit 150. Once suitably positioned, the control system of the excavator is given an input indicative of the setting of a particular e-fence (in this case left rotational stop) and this limit position is stored by the controller of the excavator as e-fence information. Similarly, the house is then rotated to the opposite rotational stop (indicated at reference numeral 152) and an additional limit input is provided. In this way, the excavator is provided with information such that during operation it will automatically inhibit any operator attempts or control inputs that attempt to move beyond the previously-set e-fence limits.

During operation, the excavator generally obtains positional information relative to the boom using an inertial measurement unit (IMU) 160 (shown in FIG. 1) mounted to boom 110. The IMU is an electronic device that measures and reports a body-specific force, angular rate, and sometimes orientation using a combination of accelerometers, gyroscopes, and occasionally magnetometers. In order to obtain positional information, the accelerometer or gyroscopic output of IMU 160 is integrated over time. While this approach is quite effective for virtually all operational modes of excavator 100, it has limitations when the signal of the accelerometer and/or gyroscope is relatively small such as during slow or low acceleration movements.

Embodiments of the present invention generally leverage the presence of a backup camera, such as backup camera 140 (shown in FIG. 1), on an hydraulic excavator with machine vision or suitable computer vision algorithms, to provide a signal that augments that of the traditional IMU. Accordingly, in contrast with prior techniques where the backup camera is only used when the operator is preparing to back the excavator, the backup camera in accordance with embodiments described herein, is continuously used and its video stream/output is processed to provide supplemental movement information in order to provide greater movement sensing and precision for the hydraulic excavator. Examples of the manner in which this improved excavator motion sensing is used is provided in at least two embodiments described below.

Figure 3:
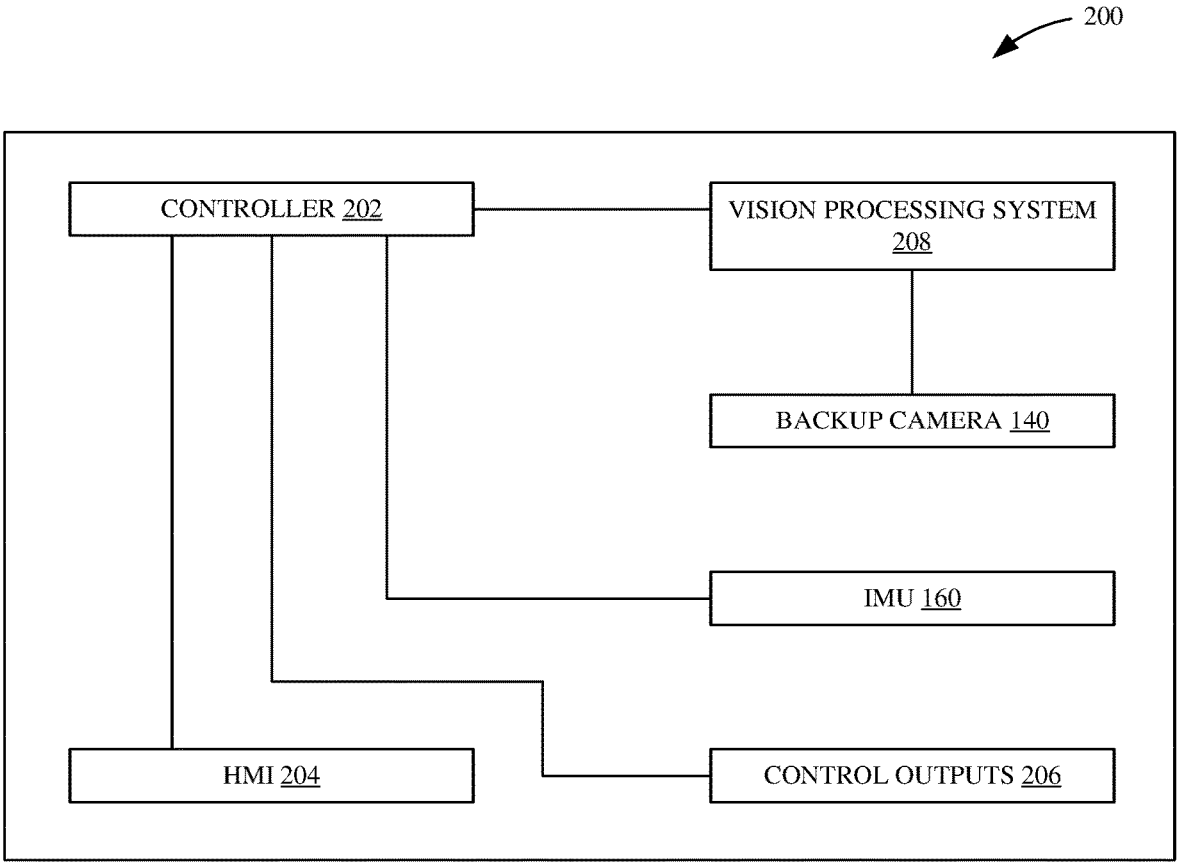
FIG. 3 is a block diagram of an excavator control system with improved movement sensing in accordance with an embodiment of the present invention.

FIG. 3 is a diagrammatic view of a control system of an excavator in accordance with one embodiment of the present invention. Control system 200 includes controller 202 that is configured to receive one or more inputs, perform a sequence of programmatic steps to generate one or more suitable machine outputs for controlling the operation of a hydraulic excavator. Controller 202 may include one or more microprocessors, or even one or more suitable general computing environments as described below in greater detail. Controller 202 is coupled to human machine interface module 204 in order to receive machine control inputs from an operator within cab 104. Examples of operator inputs include joystick movements, pedal movements, machine control settings, touch screen inputs, etc. Additionally, HMI module 204 also includes one or more operator displays in order to provide information regarding excavator operation to the operator. At least one of the operator displays of HMI module 204 includes a video screen that, among other things, may display an image from backup camera 140. Additionally, when an e-fence limit is within the field of view 142 of backup camera 140, the display may also provide an indication of such. Essentially, any suitable input from an operator or output to an operator between excavator 100 and the operator disposed within cab 104 may form part of HMI module 204. Control system 200 also includes a plurality of control outputs 206 coupled to controller 202. Control outputs 206 represent various outputs provided to the actuators, such as hydraulic valve controllers to engage the various hydraulics and other suitable systems of excavator 100 for excavator operation. As shown, control system 200 generally include IMU 160 operably coupled to controller 202 such that controller 202 is provided with an indication of the position of the boom, and to some extent stick and bucket.

In accordance with an embodiment of the present invention, backup camera 140 of control system 200 is operably coupled to vision processing system 208 which is coupled to controller 202. While vision processing system 208 is illustrated as a separate module from controller 202, it is expressly contemplated that vision processing system 208 may be embodied as a software module executing within controller 202. However, for ease of explanation, vision processing system 208 will be described as separate vision processing logic receiving a video signal from backup camera 140 and providing positional information to controller 202. Vision processing system 208 is adapted, through hardware, software, or a combination thereof, to employ visual odometry to calculate motion of the machine based on analysis of a succession of images obtained by backup camera 140. As defined herein, visual odometry, is the process of determining the position and orientation of a controlled mechanical system by analyzing associated camera images. Using visual odometry techniques, vision processing system 208 provides an estimate of machine motion to controller 202. Controller 202 then combines the estimate of machine motion received from vision processing system 208 and IMU 160 and generates composite position information of the hydraulic excavator that is more precise than using the signal of IMU 160 alone. This is because the signals from vision processing system 208 and IMU 160 complement each other in a particularly synergistic way. During relatively high speed or high acceleration movements, IMU 160 provides accurate signals relative to the machine's movement while backup camera 140 generally provides a series of blurred images. In contrast, when excavator 100 generates relatively slow or low-acceleration movements, the signal from IMU 160 is not as reliable or accurate. However, using visual odometry techniques, visual processing system 208 is able to provide very precise motion information. These two measurements for the change in swing angle are fused using controller 202 and a suitable calculation, such as a calculation that weighs a particular input modality based upon the speed or magnitude of the movement. For example, during relatively high-speed or acceleration movements, controller 202 may use the signal from IMU 160 to a significant extent, such as weighted 80% vs. 20% to visual odometry. In contrast, when the motion is slow and/or the acceleration is very low, the signals of IMU 160 may be significantly de-weighted (such as 10% vs. a 90% weight using the information from vision processing system 208). In this way, controller 202 is generally provided with enhanced positional information in virtually all contexts.

While backup camera 140 is intended to encompass any legacy or standard backup camera, it is expressly contemplated that as embodiments of the present invention are used in more and more situations, and as camera technology improves, backup camera 140 may be a relative high-speed video camera that is less susceptible to motion blur, and/or may have features that are not currently provided in commercially-available backup cameras. As used herein, backup camera 140 is intended to include any vision system that is mounted relative to an excavator and includes a field of view that is substantially opposite that from an operator sitting within cab 104. Backup camera 140 may include any suitable image acquisition system including an area array device such as a charge couple device (CCD) or a complementary metal oxide semi-conductor (CMOS) image device. Further, backup camera 140 may be coupled to any suitable optical system to increase or decrease the field of view 142 under control of controller 202. Further still, backup camera may be provided with additional illumination, such as a backup light, or dedicated illuminator, such that images can easily be acquired when excavator is operated in low-light conditions. Further still, while a single backup camera 140 is illustrated, it is expressly contemplated that an additional, or second, backup camera may also be used in conjunction with backup camera 140 to provide stereo vision. In this way, using stereo vision techniques, three-dimensional imagery and visual odometry can be employed in accordance with embodiments of the present invention.

Figure 4:
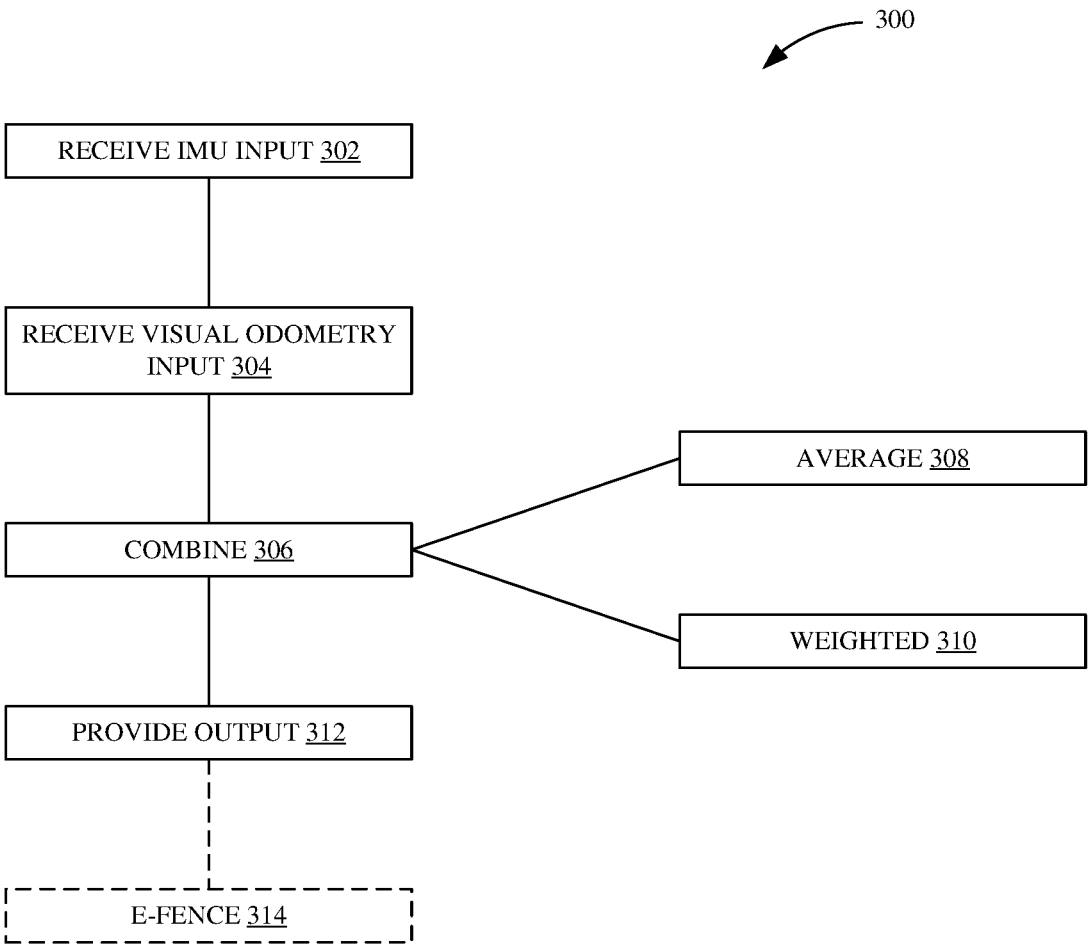
FIG. 4 is a flow diagram of a method of processing sensor inputs in a hydraulic excavator in accordance with an embodiment of the present invention.

FIG. 4 is a flow diagram of a method of providing improved position sensing in an excavator in accordance with an embodiment of the present invention. Method 300 begins at block 302 where a controller, such as controller 202, receives IMU input. At block 304, visual odometry information is received, such as from vision processing system 208. While method 300 is shown having block 304 occurring after block 302, it is expressly contemplated that the order of such information acquisition in blocks 302 and 304 can be interchanged. Regardless, by block 306, a controller, such as controller 202 has a combination of IMU information received via block 302, and visual odometry information received via block 304. At block 306, this information is combined to provide position information that has better precision than either signal alone. This combination can be done simply by averaging the positional signals, as indicted at block 308, or, by performing a weighted average based upon the magnitude of the acceleration and/or movement, as indicated at block 310. Next, at block 312, the combined positional information is provided as an output by the controller. This output may be provided as an indication to an operator via HMI module 204 (shown in FIG. 3). Further, the output may optionally be provided to e-fence processing block 314 to determine if the combined positional output is at or within a set e-fence. In this way, even if the boom of the hydraulic excavator is rotated very slowly, and the accuracy of the IMU information is reduced, the combined positional information provided via block 312 will still be of relatively high quality because it will use the visual odometry processing from block 304. Accordingly, even during very slow machine movements, e-fences will be carefully and precisely enforced. The combinational output helps compensate for motion blur in the backup camera image during high speed swings and still stabilizes the swing angle at low speeds where the system would otherwise experience drift due to integration of the gyro-noise from the IMU information, from block 302.

Figure 5:
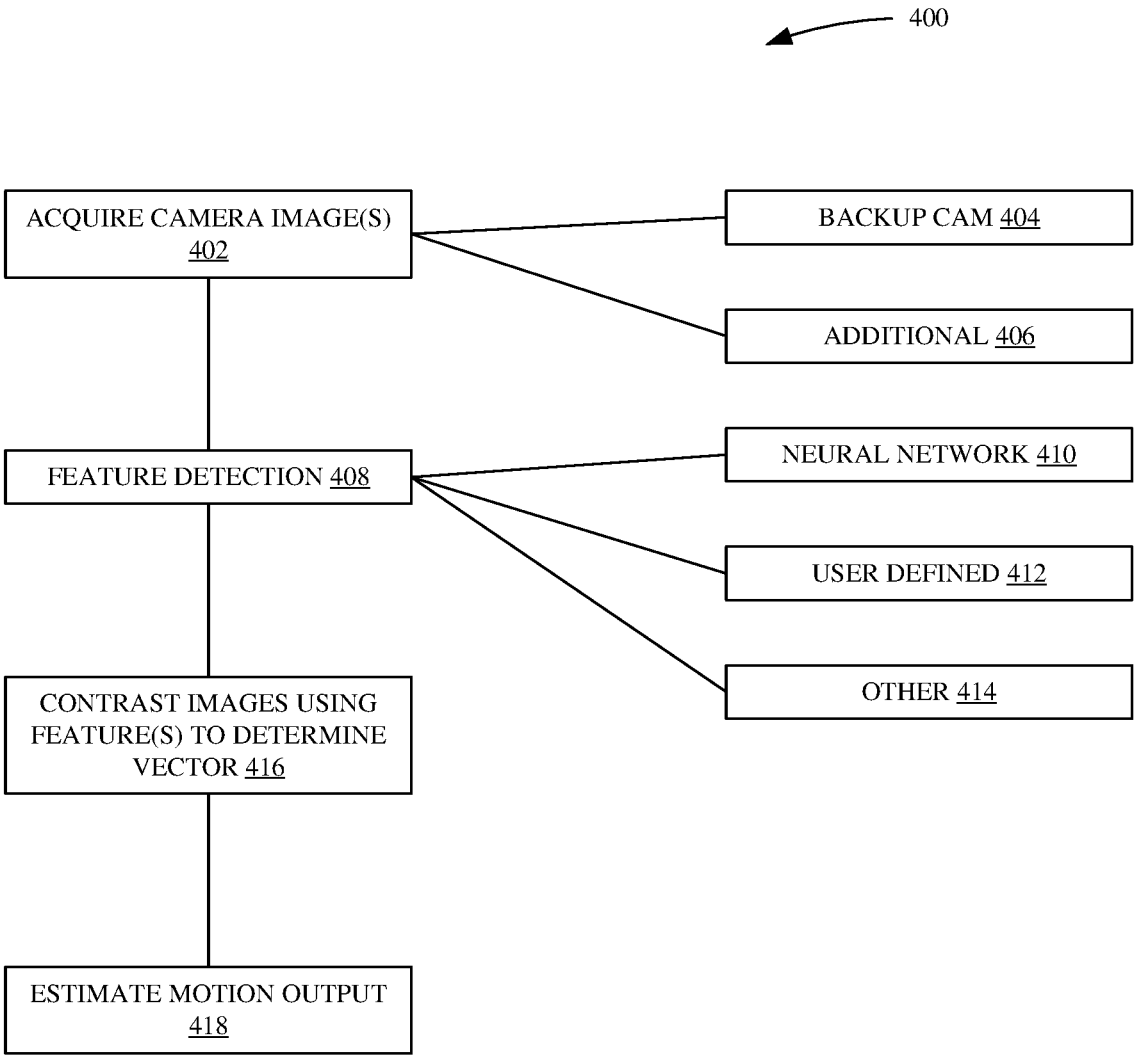
FIG. 5 is a flow diagram of a method of providing movement information based upon one or more acquired images in accordance with one embodiment of the present invention.

FIG. 5 is a flow diagram of a method of providing visual odometry for an excavator in accordance with an embodiment of the present invention. Method 400 begins at block 402 where one or more images are acquired. These images may be acquired from a backup camera, as indicated at block 404, as well as from one or more additional cameras as indicated at block 406. Once images are acquired, block 400 continues at block 408 where feature detection is performed. Feature detection is an important aspect of visual odometry in that it identifies one or more features in the images that can be used for motion detection. Accordingly, it is important that a feature not be of an object or aspect of the image that is relatively transitory or moves on its own, such as a passing worker, or an animal. Instead, feature detection 408 is performed to identify one or more features in the image that are representative of the stationary environment around the vehicle such that motion of such a detected feature is indicative of motion of the vehicle itself.

Feature detection 408 can be done using a suitable neural network detection, as indicated at block 410. Further, feature detection 408 may be explicitly performed as a user-defined operation where a user simply identifies items in an image that the user or operator knows to be stationary, as indicated at block 412. Additionally, feature detection can be also performed using other suitable algorithms, as indicated at block 414. As an example of a known feature detection technique in visual odometry, an optical flow field can be constructed, using the known Lucas-Kanade method. Further, while various different techniques are described for providing feature detection, it is also expressly contemplated that combinations thereof may be employed as well. Next, at block 416, successive images are contrasted using the features detected at block 408 to estimate a movement vector indicative of movement of the machine that generated the detected difference in features in the successive images. At block 418, this estimated motion vector is provided as a visual odometry output.

When an excavator is tracked, the vision system, in accordance with embodiments described herein, uses visual odometry to calculate motion of the excavator and recalculate swing angles associated with a previously-defined e-fence since these swing angles change when the machine moves. In this way, the operator need not reset the e-fence as the excavator is moved. In addition to this dynamic tracking, the camera images can also be processed during operation in order to identify new visual markers or features in the environment associated with the extremes of acceptable swing motion at the new position. Accordingly, features or visual markers could be leap-frogged from one machine position to another and used to maintain the position of the e-fence relative to the excavator without the need for a GPS system.

Figure 6:
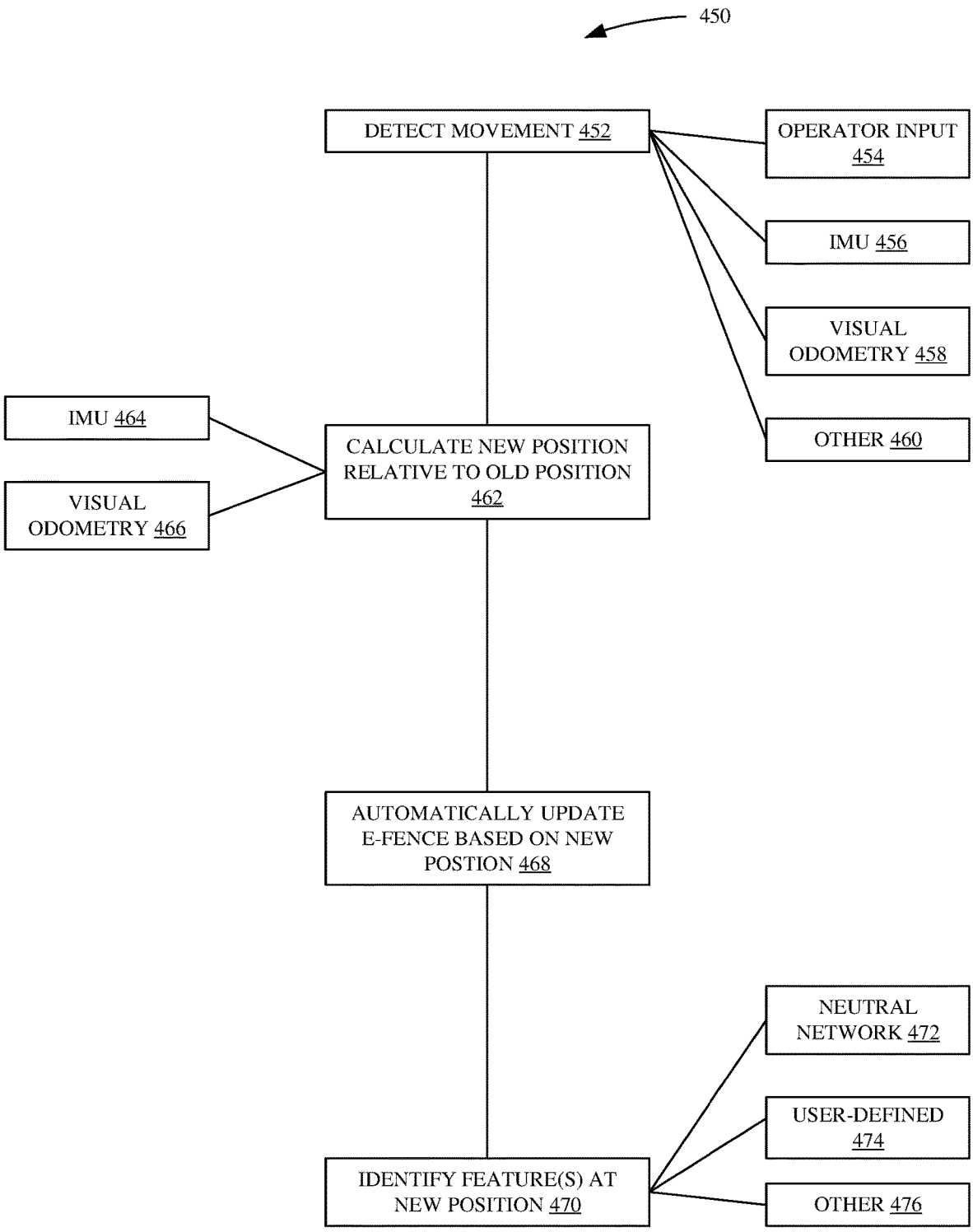
FIG. 6 is a flow diagram of a method of automatically updating e-fence information in accordance with one embodiment of the present invention.

FIG. 6 is a flow diagram of a method of automatically updating e-fence information and detecting new features upon movement of an excavator in accordance with embodiment of the present invention. Method 450 begins at block 452 where excavator movement is detected. Such movement detection can be sensed via operator input, as indicated at block 454, via IMU signals, as indicated at block 456, via visual odometry, as indicated at block 458, or via other techniques, as indicated at block 460. Once movement is detected, control passes to block 462 where a new position of the excavator is calculated relative to the old position. For example, the new position may indicate that the excavator has moved forward 12 feet and that the tracked portion has rotated 12°. As can be appreciated, when this occurs, previous e-fence information will no longer be valid. Accordingly, it is important for the e-fence to be updated to ensure the safety of the operator and those in proximity to the excavator.

Previously, upon such movement, the operator would need to manually reset the e-fence by moving to acceptable swing limits and providing operator input indicative of the position of the machine at such swing limits. This was tedious. Instead, using embodiments of the present invention, the new position can be calculated using IMU information, as indicated at block 464, and visual odometry information is indicated at block 466. Additionally, by using a priori information relative to the e-fence (e.g. it corresponds to a highway barrier, or straight line), the position of new e-fence information can be calculated based upon the a priori e-fence information and the new position of the excavator. Thus, at block 468, the controller of the excavator, such as controller 202, automatically updates e-fence information based on the new position and the a priori information of the e-fence.

Next, at block 470, method 450 automatically identifies features in images in the output of the backup camera at the new position. As indicated, feature identification can be done in a variety of ways, such as using a neural network 472, explicit user definitions 474, or other techniques 476. Accordingly, as the excavator moves, the e-fence may be automatically updated, and visual odometry may automatically identify new features at the new position to continue to provide enhanced positional information for excavator control. Thus, not only do embodiments of the present invention remove some of the tedious operations currently required of excavator operators in order to ensure safety, they also provide improved position determination and control.

In this way, embodiments of the present invention generally leverage an excavator backup camera as a vision system that automatically finds markers in the environment that inform the machine and operator of movement of the excavator and automatically propagate control boundaries (e.g., e-fence) forward relative to the barrier. This significant improvement to excavator operation and control is provided without adding significant expense to the excavator.

As described above, when a priori information relative to a barrier or e-fence is known, it can automatically be updated as the excavator position is changed. In accordance with an embodiment described herein, some of the a priori information relative to the e-fence or barrier may be obtained automatically using the backup camera and vision processing system. For example, the vision processing system may be configured to identify a concrete temporary barrier of the type used during road construction and/or traffic cones. Further, the vision processing system may be used in combination with specifically-configured e-fence markers that are physically placed in the real world to identify an e-fence. When the vision processing system identifies such markers in its field of view, it can automatically establish the a priori information. Accordingly, such vision markers could be set in a way that defines a curve and the a priori information would include extrapolation of the curve between and beyond the markers. In another example, the operator may simply rotate the house such that the backup camera views a particular barrier or at least has a field of view covering where an e-fence is desired, and may provide an operator input, such as drawing a line or curve on a touch screen displaying the backup camera image that automatically sets the a priori information.

Figure 7:
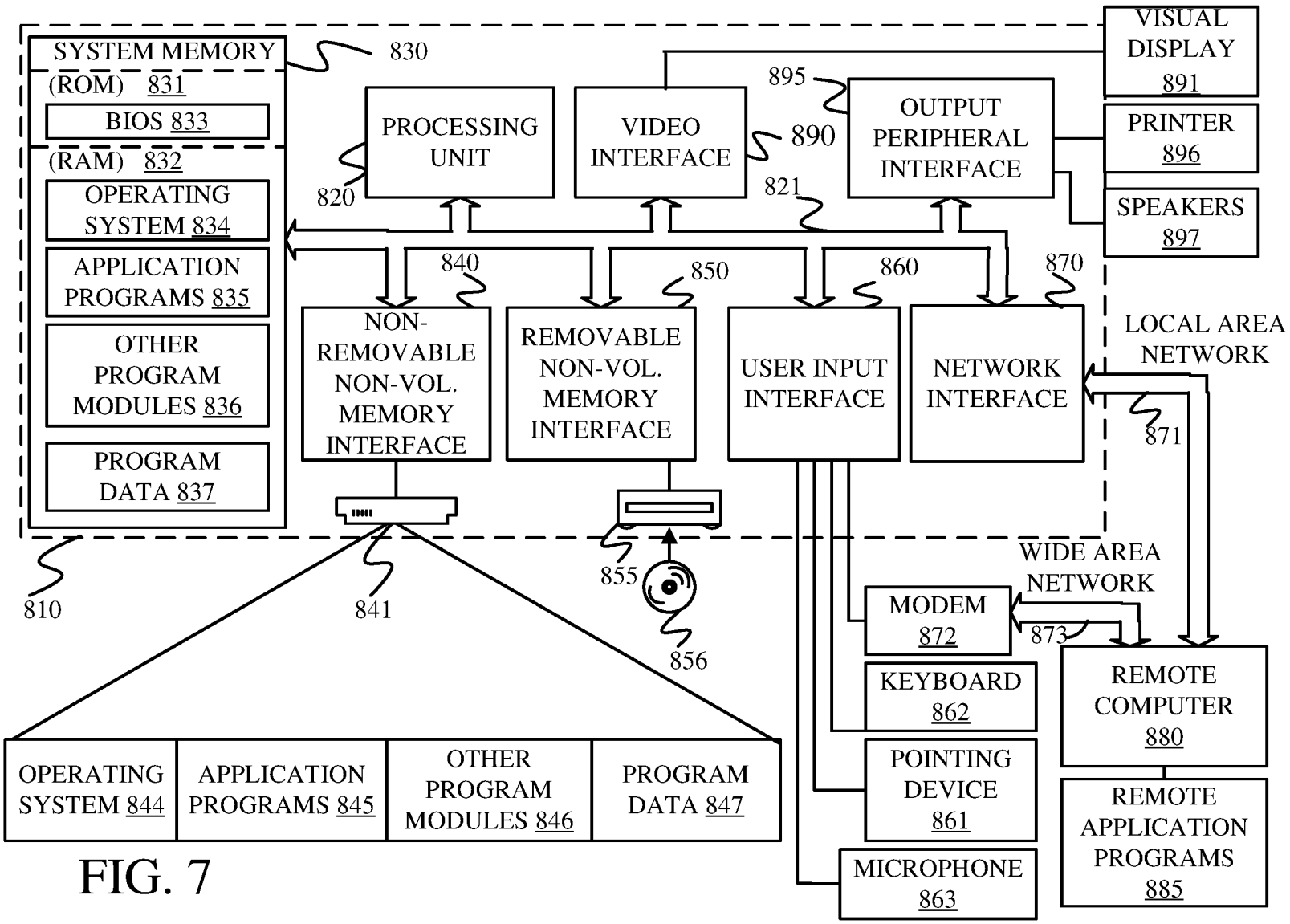
FIG. 7 is a diagrammatic view of a computing environment for processing sensing inputs in accordance with an embodiment of the present invention.

FIG. 7 is one embodiment of a computing environment in which elements of FIG. 3, or parts of it, (for example) can be deployed. With reference to FIG. 7, an exemplary system for implementing some embodiments includes a general-purpose computing device in the form of a computer 810. Components of computer 810 may include, but are not limited to, a processing unit 820 (which can comprise processor 108), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to FIG. 3 can be deployed in corresponding portions of FIG. 7.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 10 illustrates operating system 834, application programs 835, other program modules 836, and program data 837.

The computer 810 may also include other removable/non-removable volatile/nonvolatile computer storage media. By way of example only, FIG. 10 illustrates a hard disk drive 841 that reads from or writes to non-removable, nonvolatile magnetic media, a magnetic disk drive 851, nonvolatile magnetic disk 852, an optical disk drive 855, and nonvolatile optical disk 856. The hard disk drive 841 is typically connected to the system bus 821 through a non-removable memory interface such as interface 840, and magnetic disk drive 851 and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (e.g., ASICs), Program-specific Standard Products (e.g., ASSPs), System-on-a-chip systems (SOCs), Complex Programmable Logic Devices (CPLDs), etc.

The drives and their associated computer storage media discussed above and illustrated in FIG. 7, provide storage of computer readable instructions, data structures, program modules and other data for the computer 810. In FIG. 7, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 10 illustrates, for example, that remote application programs 885 can reside on remote computer 880.

It should also be noted that the different embodiments described herein can be combined in different ways. That is, parts of one or more embodiments can be combined with parts of one or more other embodiments. All of this is contemplated herein.

Example 1 is an excavator that includes a rotatable house and a bucket operably coupled to the house. An inertial measurement unit (IMU) is operably coupled to the bucket and is configured to provide at least one IMU signal indicative of movement of the bucket. A backup camera is disposed to provide a video signal relative to an area behind the excavator. A controller is coupled to the IMU and operably coupled to the backup camera. The controller is configured to receive the at least one IMU signal from the IMU and to generate a position output based on the at least one IMU signal and the video signal from the backup camera.

Example 2 is an excavator of any or all previous examples wherein the backup camera is mounted to the house.

Example 3 is an excavator of any or all previous examples wherein the bucket is pivotally mounted to a stick, which is pivotally mounted to a boom coupled to the house, and wherein the IMU is mounted to the boom.

Example 4 is an excavator of any or all previous examples wherein the controller is operably coupled to the backup camera via a vision processing system.

Example 5 is an excavator of any or all previous examples wherein the vision processing system is configured to perform visual odometry using the video signal of the backup camera substantially continuously.

Example 6 is an excavator of any or all previous examples wherein the vision processing system is separate from the controller.

Example 7 is an excavator of any or all previous examples wherein the vision processing system is configured to provide a motion vector to the controller based on analysis of successive images from the backup camera.

Example 8 is an excavator of any or all previous examples wherein the controller is configured to automatically identify at least one feature in a backup camera signal and to perform visual odometry using the identified at least one feature.

Example 9 is an excavator of any or all previous examples wherein the controller is configured to automatically identify the at least one feature using a neural network.

Example 10 is an excavator of any or all previous examples wherein the position output is provided to an operator.

Example 11 is an excavator of any or all previous examples wherein the position output is compared to an e-fence to enforce the e-fence.

Example 12 is an excavator of any or all previous examples wherein the controller is configured to generate the position output as a function of the at least one IMU signal, the backup camera video output and a magnitude of movement.

Example 13 is an excavator of any or all previous examples wherein the controller is configured to favor the at least one IMU for a higher magnitude movement and to favor the backup camera video output for a lower magnitude movement.

Example 14 is a method of generating a position output relative to a bucket of an excavator. The method includes obtaining a signal from an inertial measurement unit (IMU) operable coupled to the bucket. A video signal from a camera mounted to the excavator is also obtained. The video signal is analyzed to generate a motion vector estimate. The motion vector estimate is combined with the IMU signal to provide a position output.

Example 15 is a method of any or all previous examples wherein the position output is compared to an e-fence to determine whether the motion is at an e-fence limit.

Example 16 is a method of any or all previous examples wherein the video signal is analyzed using visual odometry.

Example 17 is a method of any or all previous examples and further comprising automatically determining at least one feature in the video signal to use for visual odometry.

Example 18 is a method of automatically updating e-fence information in an excavator. Initial e-fence information is received from an operator while the excavator is located at a first position. A priori e-fence information is received. A determination is made that the excavator has moved from the first position to a second position and a difference is calculated between the first position and the second position. E-fence information is automatically updated based on the a priori e-fence information and the difference between the first position and the second position.

Example 19 is a method of any or all previous examples wherein detecting that the excavator has moved from the first position to the second position is performed using visual odometry and a video signal from a backup camera of the excavator.

Example 20 is a method of any or all previous examples and further comprising automatically identifying at least one feature in a video signal of a backup camera of the excavator at the second position.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An excavator comprising:

a rotatable house; a bucket operably coupled to the house; an inertial measurement unit (IMU) operably coupled to the excavator and configured to provide an IMU signal indicative of rotation of the house;

a backup camera disposed to provide a video signal relative to an area behind the excavator;

a controller coupled to the IMU and operably coupled to the backup camera through a vision system separate from the controller, the controller being configured to receive the IMU signal from the IMU and to determine a position of the bucket based on a combination of the IMU signal and a motion signal based on analysis of successive images from the backup camera; and wherein the vision processing system is configured to provide the motion signal in the form of a motion vector based on analysis of successive images from the backup camera.

2. The excavator of claim 1, wherein the backup camera is mounted to the house.

3. The excavator of claim 1, wherein the bucket is pivotally mounted to a stick, which is pivotally mounted to a boom coupled to the house, and wherein the IMU is mounted to the boom.

4. The excavator of claim 1, wherein the vision processing system is configured to perform visual odometry using the video signal of the backup camera substantially continuously.

5. The excavator of claim 1, wherein the controller is configured to automatically identify at least one feature in a backup camera signal and to perform visual odometry using the identified at least one feature.

6. The excavator of claim 5, wherein the controller is configured to automatically identify the at least one feature using a neural network.

7. The excavator of claim 1, wherein the determined position is provided to an operator.

8. The excavator of claim 1, wherein the determined position is compared to an e-fence to enforce the e-fence.

9. The excavator of claim 1, wherein the controller is configured to generate the position output as a function of the IMU signal, the backup camera video signal and a magnitude of movement.

10. The excavator of claim 9, wherein the controller is configured to favor the IMU signal for a higher magnitude movement and to favor the backup camera video signal for a lower magnitude movement.

* * * * *